United States Patent [19]

Tanji et al.

[11] Patent Number: 4,732,720

[45] Date of Patent: Mar. 22, 1988

[54] PROCESS FOR THE PRODUCTION OF UNIFORMLY DYEABLE NYLON 66 FIBER

[75] Inventors: Hiroshi Tanji, Fuji; Michitaka Iwata, Minoo; Hideo Sato, Nobeoka, all of Japan

[73] Assignee: Asahi Kasei Kogyo Kabushiki Kaisha, Osaka, Japan

[21] Appl. No.: 47,553

[22] Filed: Apr. 27, 1987

Related U.S. Application Data

[60] Continuation of Ser. No. 746,750, Jun. 20, 1985, abandoned, which is a division of Ser. No. 651,646, Sep. 18, 1984, Pat. No. 4,542,063, which is a continuation of Ser. No. 350,417, Feb. 19, 1982, abandoned.

[30] Foreign Application Priority Data

Feb. 26, 1981 [JP] Japan ..... 56-26129
Mar. 17, 1981 [JP] Japan ..... 56-37242

[51] Int. Cl.[4] ..... D01D 5/084; D01D 5/088

[52] U.S. Cl. ..... 264/101; 264/211.15; 264/211.17; 264/234; 264/237

[58] Field of Search ..... 264/101, 78, 168, 235, 264/103, 211.15, 211.17, 234, 237, 345, 348; 425/725

[56] References Cited

U.S. PATENT DOCUMENTS

| | | | |
|---|---|---|---|
| 2,985,995 | 5/1961 | Bunting, Jr. et al. | 57/204 |
| 3,111,368 | 11/1963 | Romano | 425/725 |
| 3,257,487 | 6/1966 | Dulin, Jr. | 264/176 F |
| 3,517,412 | 6/1970 | Swanson et al. | 425/71 |
| 3,694,871 | 10/1972 | Ditzler | 264/210.8 |
| 4,496,505 | 1/1985 | Tanji et al. | 264/101 |
| 4,542,063 | 9/1985 | Tanji et al. | 264/210.8 |

*Primary Examiner*—Jan H. Silbaugh
*Assistant Examiner*—Hubert C. Lorin
*Attorney, Agent, or Firm*—Finnegan, Henderson, Farabow, Garrett & Dunner

[57] ABSTRACT

A nylon 66 fiber capable of being uniformly dyed is made by extruding a melt of nylon 66, passing the extruded filaments through a heating zone provided at the surface of the extrusion nozzle and having a length of at least about 5 cm to about 100 cm and a temperature of about 150° C. to about 260° C., applying a suction with an aspirator located below the heating zone, and then winding at a winding speed of at least 6,000 m/min.

2 Claims, 5 Drawing Figures

PROCESS FOR THE PRODUCTION OF UNIFORMLY DYEABLE NYLON 66 FIBER

This application is a continuation of Ser. No. 746,750 filed 6/20/85, abandoned, which was a division of Ser. No. 651,646 filed 9/18/84 now U.S. Pat. No. 4,542,063 which is continuation of Ser. No. 350,417 filed 2/19/82, now abandoned.

BACKGROUND OF THE INVENTION

The present invention relates to improved nylon 66 fiber and a process for their production. More particularly, the invention relates to nylon 66 fiber possessing a novel microstructure and improved properties such as high dye absorption, good uniformity of dyeing and good crimp performance and to a spinning process for preparing improved nylon 66 fibers involving spinning an extruded filament at a high speed.

Among polyamides fibers, nylon 66 fibers have excellent tenacity durability and stretchability and also good thermal resistance due to the high melting point, and are employed in many varied uses for apparel. On the other hand, nylon 66 fibers are poorer in uniformity of dyeing than nylon 6 fibers. For example, when nylon 66 fibers are subjected to heat processing such as false twisting, uneven dyeing easily tends to occur, compared with nylon 6 fibers, and accordingly very severe control of conditions is conducted in the steps of spinning, stretching and processing or sever production control is conducted by previously grading raw yarns before or after processing by dyeing. Such controls, however, are still not sufficient and are very disadvantageous from the viewpoint of production cost.

Known methods for improving the disadvantages of nylon 66 fibers include mixing nylon 66 with nylon 6 and copolymerizing hexamethylene adipamide with ε-caprolactam (for example, Japanese Patent Publication (unexamined) No. 72611/1976). The nylon 66 fibers produced by such methods are improved in uniformity of dyeing, but still have disadvantages such as lowering in the thermal and mechanical properties. On the other hand, it is known that the nylon 66 fibers produced by a process comprising spinning nylon 66 at a spinning speed of 3,000 m/min. to 5,000 m/min. to give pre-oriented yarns and then stretching and false twisting the pre-oriented yarns have comparatively reduced uneven dyeing. However, there are some problems such as swelling of the wound fibers, lowering in processability of the fibers and reduction in dye fastness of the textured yarns.

Generally, dyeability of polyamide fibers depends upon the concentration of terminal amino groups and the microstructure in dyeing with an acid dye or a metal complex dye or depends upon the microstructure of the fibers in dyeing with a disperse dye. Especially uniformity of dyeing of polyamide fibers is greatly influenced by the microstructure and its scattering. Further, nylon 66 fibers are denser in the microstructure than nylon 6 fibers, and the migration of dye within the nylon 66 fibers and among the nylon 66 fibers is lower and uniformity of dyeing is also inferior since the transformation of the microstructure may easily be caused by absorbed moisture due to the high capability of forming hydrogen bonds.

It is proposed that dyeability of nylon 66 fibers is improved by modifying the microstructure, but according to conventional nylon 66 fibers there is a contradictive relationship among dyeability such as dye absorbability, uniformity of dyeing and crimp performance. When one of these properties is improved, the others are deteriorated, and such nylon 66 fibers as to satisfy all these properties have not been obtained.

SUMMARY OF THE INVENTION

An object of the present invention is to provide a nylon 66 fiber having good uniformity of dyeing.

Another object of the present invention is to provide a process for producing a nylon 66 fiber with improved spinning stability at a high spinning speed.

Additional objects and advantages of the invention will be set forth in the description that follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, the fiber of the present invention consists essentially of nylon 66 having good uniformity of dyeing and having an initial modulus at 20° C. and a relative humidity of 60% of about 15 g/d to about 65 g/d and a relationship of a peak temperature [$T_{max}$(°C.)] at peak of dynamic mechanical loss tangent (tan δ) measured with a frequency of 110 Hz and a peak value of the dynamic mechanical loss tangent [(tan $\delta)_{max}$] represented by the equation:

$$T_{max}(°C.) \leqq -320(\tan\delta)_{max} + 132$$

Further to achieve the foregoing objects and in accordance with the purpose of the invention, as embodied and broadly described herein, the process of the present invention for producing a nylon 66 fiber comprises extruding a melt of nylon 66, passing the extruded filaments through a heating zone provided at the surface of the nozzle and having a length of at least about 5 cm and a temperature of about 155° C. to about the melting point of the polymer, applying a suction with an aspirator located below the heating zone, and then winding at a winding speed of at least about 4,000 m/min.

The accompanying drawings, which are incorporated in and constitute a part of this specification, illustrate the invention and, together with the description, serve to explain the principles of the invention.

DESCRIPTION OF THE PREFERRED EMBODIMENTS

Figure 1:
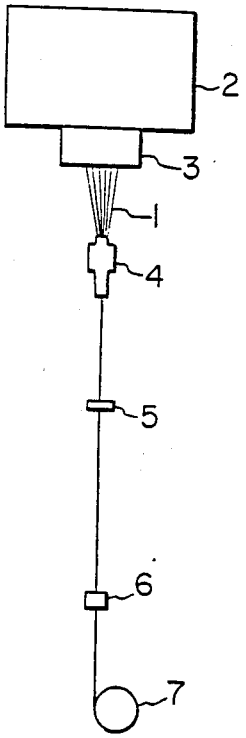
FIG. 1 is a diagram illustrating one embodiment of an apparatus employed in the process of the present invention, in which the numbered elements are as follows: 1, extruded filaments; 2, a spinhead with a nozzle; 3, a heating zone; 4, aspirator; 5, a device for oiling; 6, a device for entangling filaments; and 7, a godet roll or winder.

Reference will now be made in detail to the presently preferred embodiments of the invention, examples of which are illustrated in the accompanying drawings.

As a result of a study on the microstructure of nylon 66 fibers, especially the amorphous region of microstructure of nylon 66 fibers and the relationship between uniformity of dyeing and both of a peak value of dynamic mechanical loss tangent [$(\tan\delta)_{max}$] and a peak temperature [$T_{max}$(°C.)], it has been found that only a nylon 66 fiber having specific values of the $(\tan\delta)_{max}$ and the $T_{max}$(°C.) which are different from those of conventional fibers has excellent uniformity of dyeing.

There is proposed a method of quantitatively evaluating the microstructure of amorphous region of nylon 66 fibers by using a mechanical loss tangent (tan δ)-temperature (T) curve [see Kenji Kamide and Seiichi Manabe, "Sen-i Gakkai Shi", Vol. 34, No. 3, Pages 70–79 (1978)]. It is found according to this method that a size of the absorption ($\alpha_a$) appearing due to the micro-Brownian motion of the main chain is approximately positively correlated with dyeability such as an equilibrium dye absorption.

Also it has been found that a nylon 66 fiber having a novel structure such that refractive indices are different between an outer layer of the fiber and inner layer of the fiber has excellent uniformity of dyeing, crimp performance and sufficient dye absorption for practical use.

Further, it has been found that spinning stability at a high speed spinning can be improved by a specific process comprising subjecting extruded filaments to a suction with an aspirator provided below the nozzle and spinning at a specific speed.

Furthermore, it has been found that spinning stability at high speed spinning could be further improved by a process further comprising subjecting extruded filaments to a heating zone having a specific length before the suction.

Nylon 66 which can be employed in the present invention is polyhexamethylene adipamide obtained by polymerization of hexamethylene diamine and adipic acid and may contain known additives such as a delustering agent, an antistatic agent, a stabilizer and a terminal group regulating agent and also comonomers in such an amount as not to adversely affect the properties of nylon 66.

A nylon 66 fiber of the present invention is characterized by a relationship of a peak temperature [$T_{max}$(°C.)] at peak of dynamic mechanical loss tangent (tan δ) measured with a frequency of 100 Hz and a peak value of the dynamic mechanical loss tangent [$(\tan\delta)_{max}$] represented by the equation:

$$T_{max}(°C.) \leqq -320(\tan\delta)_{max} + 132$$

On the other hand, all the conventional nylon 66 fibers produced by a usual process comprising spinning and stretching have limited values of the $(\tan\delta)_{max}$ and the $T_{max}$(°C.) which can be represented by the equation:

$$T_{max}(°C.) \geqq -320(\tan\delta)_{max} + 140$$

although the microstructure of the conventional nylon 66 fibers may considerably vary depending upon the stretching ratio employed.

In the case of such conventional fibers it has been considered that the transformation of the microstructure with the lapse of time which is a factor for reducing uniformity of dyeing is generally smaller with increased $T_{max}$(°C.) values. Accordingly, it has been considered that in order to reduce the transformation of the microstructure and at the same time to improve the uniformity of dyeing the $T_{max}$(°C. ) has to be increased. As the method of increasing the $T_{max}$(°C.), generally the drawing ratio has been increased. When a filament is stretched at a high stretching ratio, the $T_{max}$(°C.) certainly increases and the transformation of the microstructure with the lapse of time consequently decreases, but the $(\tan\delta)_{max}$ also decreases and dyeability such as dye absorption reduces. When the stretching ratio is further increased and the $T_{max}$(°C.) exceeds about 120°, uniformity of dyeing inversely decreases. Thus, there is a limitation in improvement of uniformity of dyeing of the conventional nylon 66 fibers having a relationship of the $(\tan\delta)_{max}$ and the $T_{max}$(°C.) represented by the equation:

$$T_{max}(°C.) \geqq -320(\tan\delta)_{max} + 140$$

and such improvement is not sufficient. The conventional nylon 66 fibers for practical use in forming cloth have a $T_{max}$(°C.) of 110° C. to 140° C. and a $(\tan\delta)_{max}$ of 0.09 to 1.15.

On the other hand, as a result of study, it has been found that when the $T_{max}$(°C.) and the $(\tan\delta)_{max}$ satisfy the equation:

$$T_{max}(°C.) \leqq -320(\tan\delta)_{max} + 132$$

the transformation of the microstructure with the lapse of time is small and, at the same time, the migration of dye becomes better and the uniformity of dyeing is remarkably improved. When the $T_{max}$(°C.) and the $(\tan\delta)_{max}$ satisfy the equation:

$$T_{max}(°C.) \leqq -320(\tan\delta)_{max} + 125$$

more preferred uniformity of dyeing can be obtained. In this invention, when the $(\tan\delta)_{max}$ becomes larger, dyeability such as an equilibrium degree of dye absorption and softness of the fiber increase while dimensional stability and thermal stability of the microstructure decrease. The softness of the fiber is evaluated by the dynamic elasticity at 100° C. ($E'_{100}$), and the smaller the $E'_{100}$ becomes, the fiber is the softer. Thus, it is preferred that the $(\tan\delta)_{max}$ is about 0.15 or less. Also, in order to lower the dyeing temperature, it is preferred that the $T_{max}$(°C.) is in the range of about 80° C. to about 105° C.

Figure 2:
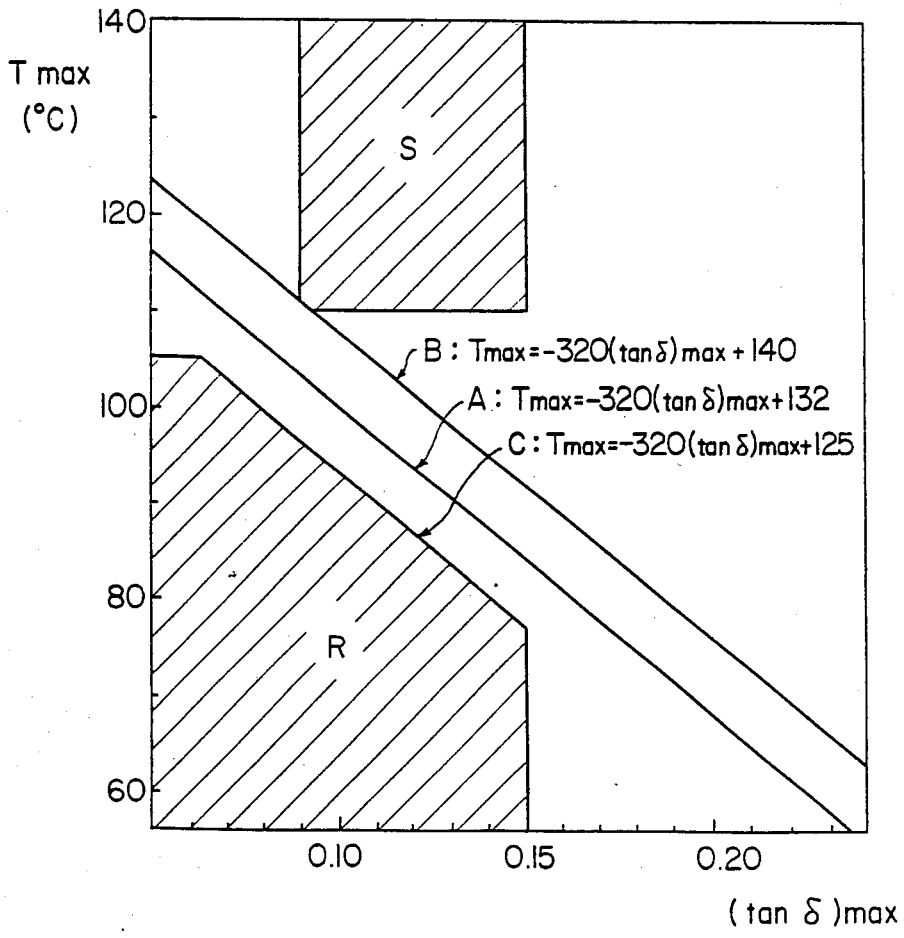
FIG. 2 is a graph illustrating the range of (tan $\delta)_{max}$ and $T_{max}$ of the fibers according to the present invention.

FIG. 2 is a graph illustrating the range of the $(\tan\delta)_{max}$ and the $T_{max}$ of the fiber according to the present invention, in which the area below the line A:

$$T_{max}(°C.) = -320(\tan\delta)_{max} + 132$$

including the line shows the scope of the present invention, the area above the line B:

$$T_{max}(°C.) = -320(\tan\delta)_{max} + 140$$

including the line shows the scope of the conventional nylon 66 fiber produced by a spinning-stretching process, the oblique lined area R below the line C:

$$T_{max}(°C.) = -320(\tan\delta)_{max} + 125$$

including the boundaries shows the scope of a preferred range of this invention and another oblique lined area S including the boundaries shows the scope of a conventional nylon 66 fiber for practical use in forming cloth.

In the present invention, in order for a nylon 66 fiber to have satisfactory properties for practical use, it is necessary that the initial modulus of the nylon 66 fiber at 20° C. and a relative humidity of 60% is in the range of about 15 g/d to about 65 g/d. For the same reason, the birefringence index ($\Delta n$) at the center of a fiber is preferably about $30\times10^{-3}$ to about $60\times10^{-3}$, more preferably about $35\times10^{-3}$ or more, most preferably about $45\times10^{-3}$ or more.

Various parameters to be used for specifying the microstructure of the crystilline region of a nylon 66 fiber in this invention are apparent crystallite size at the (100) face (ACS), crystalline orientation at the (100) face (CO), crystal perfection index (CPI) and integral wide ratio of crystallinity (IWR) which are related to mechanical properties of the fiber such as tenacity and initial modulus and to thermal properties such as dimensional stability and thermal stability of the microstructure.

In the present invention, in order for the nylon 66 fiber to have sufficient tenacity, elongation, modulus and dimensional stability and further thermal stability of the microstructure for use in forming cloth, the ACS is preferably in the range of about 40 Å to about 65 Å, more preferably about 45 Å to about 65 Å, and the CO is preferably in the range of about 85% to about 98%, more preferably about 87% to about 98%. When the ACS is less than about 40 Å, the transformation of the microstructure accompanying increased temperatures or absorbed moisture tends to become great, the tenacity easily decreases under heating and the dimensional stability in wet state or at heating also easily decreases. When the CO is less than about 85%, the reduction in initial modulus at heating tends to increase.

In the present invention, the CPI is preferably about 50% or more, the IWR is preferably about 0.20 or more and the dynamic mechanical loss tangent at 180° C. [$(\tan\delta)_{180}$] is preferably about 0.03 or less, so that the lowering of dimensional stability of the fiber and initial modulus under heating can be reduced. When the $(\tan\delta)_{180}$ is more than about 0.03, the irreversible lowering of dynamic elasticity (E') accompanying increased temperatures tends to increase. The ACS, CO, CPI and IWR of the present invention are measured by X-ray diffraction described below, and the $(\tan\delta)_{180}$ is measured at the time of measurement of the $(\tan\delta)_{max}$ and the $T_{max}$(°C.).

Furthermore, when the difference of average refractive index [$\Delta n_{\parallel(0.8-0)}$] between the average refractive index [$n_{\parallel(0)}$] at the center of a fiber and the refractive index [$n_{\parallel(0.8)}$] at a position 0.8 times from the center of the cross section of the fiber is within a preferred range of about $3\times10^{-3}$ to about $10\times10^{-3}$, the fiber is remarkably improved in uniformity of dyeing. Moreover, when the $\Delta n_{\parallel(0.8-0)}$ is about $4\times10^{-3}$ to about $10\times10^{-3}$, the fiber is remarkably improved in crimping performance as well as uniformity of dyeing.

The $\Delta n_{\parallel(0.8-0)}$ is a parameter for the distribution of a local average refractive index at the cross section of a fiber. In the present invention, the nylon 66 fiber has a $\Delta n_{\parallel(0.8-0)}$ of about $3\times10^{-3}$ or more between an inner layer of the fiber and an outer layer of the fiber, and such a nylon 66 fiber has not previously been known since the conventional nylon 66 fiber has a very small range of the $\Delta n_{\parallel(0.8-0)}$ of about $0.0\times10^{-4}$ to about $1.0\times10^{-3}$. Further, it has not been known that there is a relationship between the $\Delta n_{\parallel(0.8-0)}$ and uniformity of dyeing. It has now been found that uniformity of dyeing is closely related to the $\Delta n_{\parallel(0.8-0)}$ with the nylon 66 fiber having a $\Delta n_{\parallel(0.8-0)}$ of about $1.0\times10^{-3}$ or more and that uniformity of dyeing can be improved to a great extent in the case of a $\Delta n_{\parallel(0.8-0)}$ of about $3\times10^{-3}$ or more. When the $\Delta n_{\parallel(0.8-0)}$ is less than about $3\times10^{-3}$, uniformity of dyeing cannot be improved sufficiently and occurrence of uneven dyeing is unavoidable.

In addition to the above described properties, it is preferred from the viewpoint of excellent mechanical properties and dimensional stability that the nylon 66 fiber of this invention has an average refractive index [$n_{\parallel(0)}$] of at least about 1.57.

Furthermore, in the present invention the local refractive index is preferably distributed symmetrically around the center of the cross section of a fiber, so that uneven dyeing of the knitted and woven fabric prepared from the fiber hardly occurs and the fabric product having good appearance can be obtained. The local average refractive index distributed symmetrically around the center of the cross section of a fiber means that the minimum value of the average refractive index [$n_{\parallel(0)}$] is about [$n_{\parallel(0)} - 10\times10^{-3}$] or more, that a minimum value of the $n_{\parallel(0)}$ is positioned within a distance of 0.15 times the radius from the center of the fiber ($0.15\sim-0.15$), and that the difference between the $n_{\parallel(-0.8)}$ and the $n_{\parallel(0.8)}$ is about $2\times10^{-3}$ or less. Values of $n_{\parallel(0)}$, $n_{\parallel(0.8)}$, $n_{\parallel(-0.8)}$ and $\Delta n$ described above are measured by methods using an interference microscope discussed below.

The fiber of the present invention is prepared by a high speed spinning process of at least about 4,000 m/min., for example, at about 6,000 m/min. or more, preferably about 8,000 m/min. or more. In the present invention, a fiber having desirable properties is preferably prepared with good efficiency and stability of spinning at high speed spinning when cooling and solidification and dimensional transformation of nylon 66 extruded from a nozzle are controlled by regulating conditions such as polymer viscosity, spinning temperature, conditions of the atmosphere below the nozzle, the method for cooling filaments, and the speed of spinning. It is important to control the cooling and solidification of extruded filaments, especially since sudden cooling and solidification of extruded filaments and cooling and solidification by use of cooling air having a low temperature in a single direction crossing at a right angle to the filament, are not preferable to achieve good spinning efficiency and desirable properties. Such sudden cooling and solidification at a low temperature of 0° C. or less should be avoided because an unsymmetrical distribution of a local refractive index at a cross section of the fiber and natural crimp are caused.

The spinning speed of the present invention is defined as that of the first godet roll or winding speed in the case of a godetless process by which a cooled and solidified filament is wound after an entangling process and a lubrication treatment, if necessary. According to the process of the present invention, a high speed spinning process can be conducted stably at about 4,000 m/min. or more. More preferably, a process of spinning at about 6,000 m/min. or more can prepare the nylon 66 fiber of the present invention capable of being uniformly dyed.

It is preferred in the process of the present invention that an extruded filament passes through a heating zone maintained at a temperature of about 150° C. to about the melting point of the nylon 66, preferably about 150° C. to about a temperature below 15° C. from the melting point of the nylon 66, and having a length of at least about 5 cm from the surface of the nozzle.

The heating zone of the present invention can be formed, for example, by providing circular heating apparatus having a suitable inside diameter depending on the arrangement of fine holes on the surface of the nozzle. Known heaters can be employed in the circular heating apparatus, but an electric heater is preferred in terms of efficiency. Instead, the heating zone can be supplied with a heated fluid in an area of about 5 cm or more below the surface of the nozzle, or it can be a cylindrical tube attached to the surface of the nozzle, which in turn heats the fluid within the tube. The length of the heating zone must be at least about 5 cm. When it is less than about 5 cm, spinning cannot be carried out stably under high speed winding. The upper limit of the length of the heating zone is not particularly critical. A length of about 100 cm or less is preferred, however, in terms of cost of equipment and performance.

The most preferred length of the heating zone is, however, depending on spinning conditions such as spinning temperature and denier of filament, about 20 cm to about 100 cm. The atmosphere in the heating zone can be air, nitrogen, steam, etc. Generally, air is preferred. The temperature of the atmosphere must be about 150° C. to about the melting point of nylon 66. When the temperature of the heating zone is less than about 150° C., the annealing effect is insufficient and stable spinning cannot be carried out under high speed spinning. When the temperature of the heating zone is more than about the melting point of the nylon 66, the filaments stick together and vibrate, and therefore the spinning stability decreases. The temperature of about 150° C. to a temperature below 15° C. from the melting point of the nylon 66 is preferred. The temperature of the heating zone of the present invention means the temperature in the neighborhood of the filaments in the heating zone. The heating zone enhances the operability of a commercial process and high spinning stability and efficiency.

Figure 5:
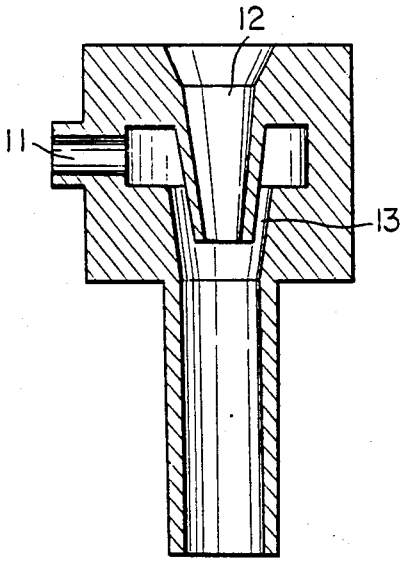
FIG. 5 is a vertical section of one embodiment of the aspirator of the present invention, in which the numbered elements are as follows: 11, a hole for supplying compressed fluid; 12, a hole for introducing filaments; and 13, a hole for introducing fluid.

An important element of the process of the present invention is that the filaments are subjected to a suction applied by an aspirator. As the aspirator of the present invention, apparatus that can generate a stream in a direction parallel to the running filament can be employed. For example, the aspirator described in Japanese Patent Publication (unexamined) No. 151611/1979 can be employed. One embodiment of an aspirator that can be used in the present invention is shown in FIG. 5. The filaments introduced through hole 12 are pulled by suction from the compressed fluid introduced through hole 13. The distance between the heating zone and the aspirator is determined by spinning conditions such as the amount of the nylon 66 extruded, the number of filaments, the temperature of the heating zone, and the spinning speed. When it is too short, the filaments stick together at the aspirator. On the other hand, when it is too long, a high pressure and a high flux are required to obtain sufficient effect from the aspirator. Therefore, the distance between the heating zone and the aspirator is preferably about 5 cm to about 60 cm, more preferably about 10 cm to about 40 cm.

Various fluids can be supplied to the aspirator, e.g., air, nitrogen, and steam, but generally air is preferred. The pressure and flux of the fluid are determined by the denier of the filament, the number of filaments, and the spinning speed. It is preferred, however, to give the filaments a velocity of more than one tenth of the spinning speed. The velocity that filaments are given by the aspirator is calculated from the denier of filaments passed through the aspirator and the amount of the nylon 66 extruded.

The temperature of the fluid is preferably room temperature (20° C.) or higher. Fluid having an extremely low temperature probably results in inferior properties and also detrimentally affects cost.

The fluid of the aspirator is supplied from the circumferential direction of the filament and in a direction parallel to the running filament. Use of both the heating zone and the aspirator in the process of the present invention achieves high spinning efficiency and stability at high speed spinning.

In the next step of the present invention, the filament leaving the aspirator is wound at a speed of at least about 4,000 m/min., preferably less than about 12,000 m/min., more preferably about 6,000 m/min. to about 10,000 m/min., and still more preferably 8,000 m/min. to about 10,000 m/min.

When the spinning speed is about 4,000 m/min. or less, the properties of the fiber such as tenacity, elongation, initial modulus, shrinkage, etc., are inadequate for practical use. An especially excellent fiber having no natural crimp and good uniformity of dyeing is prepared at a spinning speed of about 8,000 m/min. or more. On the other hand, when the spinning speed is over about 12,000 m/min., a suitable fiber is not prepared, because filaments break easily even though other conditions are within preferred ranges.

If necessary, a conventional cooling device using cooled air can be employed between the heating zone and the aspirator, or after the aspirator in the present invention. The aspirator also can serve as a cooling device when a cooling device is not provided.

When the filaments are spun, a known lubrication treatment as described in Japanese Patent Publication (examined) No. 21925/1966, and if necessary a known entangling treatment as described in U.S. Pat. No. 2,985,995 can be carried out at a suitable location between the aspirator and the winder. The winder that can be used in the present invention can be, for example, a high speed winder described in "Sen-i Gakkai-shi" 33, No. 5, T209.

One embodiment of an apparatus which can be employed in the process of this invention is illustrated in FIG. 1, in which a melt of nylon 66 is extruded from a nozzle (not illustrated) mounted in a spinhead 2 having been heated at a predetermined temperature, and is cooled in the atmosphere to form filaments 1. In this apparatus, a heating zone 3, for example, a heating cylinder surrounding the extruded filaments 1 is provided on the surface of the nozzle, and an aspirator 4 is provided below the heating zone 3 to suck and cool the filaments 1. The filaments passed through the heating zone 3 and the aspirator are treated by a device oiling 5 and a device for entangling filaments 6, and then are wound by a winder 7.

The fiber of the present invention can be used as a filament itself. Furthermore, the fiber can be subjected to false twisting or texturizing by fluid. The fiber also can be knitted or woven alone or mixed with other fibers. The staple fiber that is made from the fiber of the present invention can be used as a spun yarn or a mixed yarn.

The fiber of the present invention may be highly efficiently processed during subsequent processing. Furthermore, since the knitted and woven fabric prepared from the fiber of the present invention has high quality, the fiber of the present invention is useful for cloth.

The process of the present invention makes it possible to conduct stable spinning at high speed spinning of at least about 4,000 m/min. to about 12,000 m/min., which was extremely difficult to do previously.

METHODS FOR MEASURING PARAMETERS TO BE USED FOR SPECIFYING THE STRUCTURAL PROPERTIES OF THE PRESENT INVENTION

A. Dynamic Mechanical Loss Tangent (tan δ) and Dynamic Elasticity (E')

The dynamic mechanical loss tangent (tan δ) and the dynamic elasticity (E') can be measured by using the apparatus for measuring dynamic elasticity manufactured by Toyo Baldwin, Rheo-Vibron DDV-IIc, at a frequency of 110 Hz, in dry air and at a temperature increasing at the rate of 10° C./min.

Figure 3:
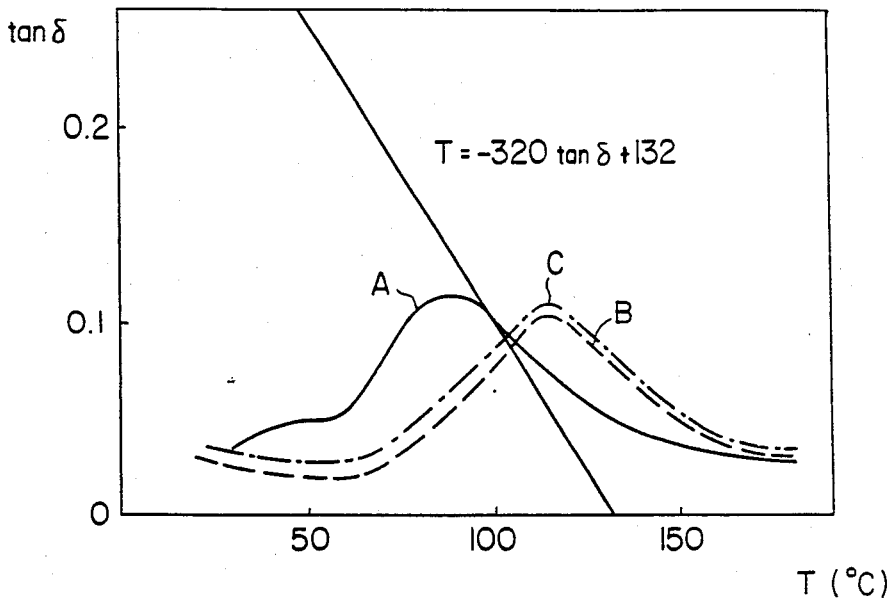
FIG. 3 is a graph illustrating a dynamic mechanical loss tangent (tan δ)-temperature (T) curve.

The peak temperature of tan δ (T max) and the peak value of tan δ ((tan δ) max) are given from the tanδ-temperature curve. Typical embodiments of a tan δ-temperature curve are illustrated in FIG. 3, wherein A represents a fiber of the present invention, B and C represent conventional stretched fibers obtained by stretching the same unstretched fibers at a different stretching ratio, i.e., at a higher stretching ratio with B.

B. Birefringence Index (Δn)

The birefringence index (Δn) can be determined from a refractive index polarized light vibrating in the direction parallel to the fiber axis ($n_{\parallel}$) and a refractive index to polarized light vibrating in the direction perpendicular to the fiber axis ($n_{\perp}$) in accordance with the equation:

$$\Delta n = n_{\parallel} - n_{\perp}$$

using green radiation (wavelength λ=549 mμ) at 25° C. and a transmisssion quantitative type interference microscope manufactured by Carl-Zeiss Yena Co., East Germany. The center of a fiber is defined as the center of gravity of the cross section of the fiber which is assumed to be a plane whether the fiber has a round cross section or a modified cross section.

C. Refractive Index ($n_{\parallel}$ or $n_{\perp}$) and Distribution of Local Refractive Index According to the interference fringe method using a transmission quantitative type interference microscope (for example, an interference microscope "Interphako" manufactured by Carl-Zeiss Yena Co., East Germany), the refractive index and the distribution of the local refractive index, observed from the side face of the fiber, can be determined.

The refractive index of fibers is characterized by a refractive index to polarized light having an electric field in the direction parallel to the fiber axis ($n_{\parallel}$) and a refractive index to polarized light having an electric field in the direction perpendicular to the fiber axis ($n_{\perp}$).

Refractive indices ($n_{\parallel}$ and $n_{\perp}$) obtained by using green radiation (wavelength λ=546 mμ) are employed. The fiber to be tested is immersed in a medium inert to fibers having a refractive index (N) giving a deviation of the interference fringe in the range of 0.2 to 2.0 times the wavelength by using optionally flat slide glass and cover glass.

The refractive index (N) of the medium is a value measured at 20° C. by an Abbe refractometer using green radiation (wavelength λ=546 mμ).

Several filaments are immersed in the medium so that the filaments are not in contact with one another. The fiber should be disposed so that the fiber axis is perpendicular to the optical axis of the interference microscope and the interference fringe. The pattern of the interferece fringe is photographed and enlarged at about 1,500 magnifications for analysis.

Figure 4:
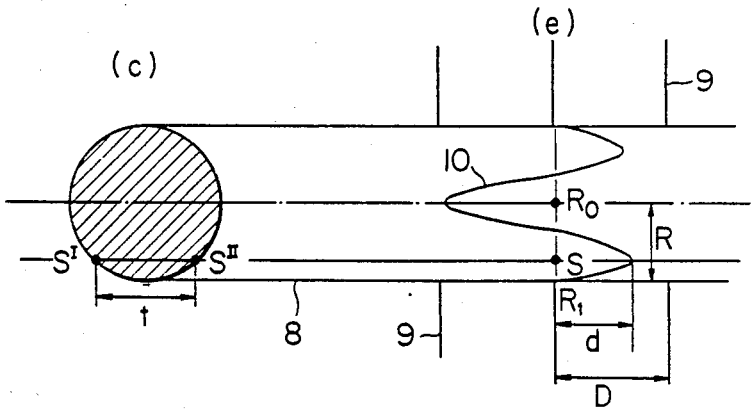
FIG. 4 is one embodiment of a pattern of interference fringe that was used to measure a distribution of a refractive index ($n_{\parallel}$ or $n_{\perp}$) in the direction of a radius of a cross section of a fiber, in which (c) is a cross section of a fiber and (e) is a pattern of an interference fringe in which the numbered elements are as follows: 8, a fiber; 9, an interference fringe by a medium; and 10, an interference fringe by a fiber.

Referring to FIG. 4, the optical path difference R is represented by the formula $$R = d/D\lambda = (n_{\parallel} \text{ or } n_{\perp}) - N)t$$

wherein M is the refractive index of the medium; $n_{81}$ or $n_{\perp}$ is the refractive index between $S^{I}$–$S^{II}$ at the fiber; t is the thickness between $S^{I}$–$S^{II}$; λ is the wavelength of the radiation used; D is the distance (corresponding to 1λ) between parallel interference fringes of the background; and d is the deviation of the interference fring by the fiber.

From optical path differences at respective positions in the range of the center of the fiber (Ro) to the periphery of the fiber (R), the distribution of the refractive index $n_{\parallel}$ or $n_{\perp}$) of the fiber at the respective positions can be determined. When r is the distance from the center of the fiber to the respective position, the refractive index at the center of the fiber, i.e., X=r/R=O is defined as the average refractive index ($n_{\parallel(0)}$ or $n_{\perp(0)}$]. X is 1 at the position of the periphery of the fiber, but X is a value of 0 to 1 at the other position of the fiber.

For example, $n_{\parallel(0.8)}$ or $n_{\perp(0.8)}$ represents the refractive index at the position of X=0.8.

D. Apparent Crystallite Size (ACS)

The apparent crystallite size (ACS) can be determined by measuring the X-ray diffraction intensity in the equatorial direction by the symmetrical reflection method. The measurement is carried out by using an X-ray generator (RU-200PL manufactured by Rigaku Denki), a goniometer (SG-9R manufactured by Rigaku Denki), a scintillation counter and a pulse height analyzer. Cu-K α (wavelength λ=1.5418 Å) monochromatized by a nickel filter is used for the measurement. The fiber sample is set in an aluminum sample holder composed in such a manner that the fiber axis is perpendicular to the plane of the X-ray diffraction. The thickness of the sample is adjusted to about 0.5 mm.

The X-ray generator is operated at 30 kV and 80 mA. The diffraction intensity is recorded from 7° to 35° of 2θ at a scanning speed of 1°/minute for 2θ, a chart speed of 10 mm/minute, a time constant of one second with a divergent slit of ½°, a receiving slit of 0.3 mm, and a scattering slit of ¼°. The full scale deflection of the recorder is set so that the entire diffraction curve remains on the scale and that at least the maximum intensity value does not exceed 50% of the full scale.

Generally, the fiber of this invention has two major reflections on the equatorial line in the range of from 20.0° to 24.5° of $2\theta$ (at the face of (100), in a smaller angle and at the faces of (010), and (110) in a greater angle).

For example, ACS is determined according to the equation of Scherrer described in L. E. Alexander, "X-ray diffraction", Chapter 7, published by Kagaku Dojin Shuppan.

A base line is established by drawing a straight line between 7° and 35° of $2\theta$ on the diffraction intensity curve. A vertical straight line is dropped from the diffraction peak to the base line, and the mid-point between the peak and the base line is marked. A horizontal line passing through the mid-point is drawn on the diffraction intensity curve. If the two major reflections are sufficiently separated from each other, this line intersects shoulders of the two peaks of the curve, but if they are not sufficiently separated, the line intersects one shoulder alone. The width of the peak is measured. If the line intersects one shoulder alone, the distance between the intersecting point and the mid-point is measured and doubled. If the line intersects two shoulders, the distance between the two shoulders is measured. The measured value is converted to a line breadth in radians and the line breadth is corrected according to the formula:

$$\beta = \sqrt{B^2 - b^2}$$

wherein B is the observed line breadth, and b is the broadening constant in radians, which is determined by the half value width of the reflection peak of a silicon single crystal at the face (111) thereof.

The apparent crystallite size is given by the equation:

$$ACS(\text{Å}) = K \cdot \lambda / \beta \cos \theta$$

wherein K is taken as one, $\lambda$ is the X-ray wavelength (1.5418 Å), $\beta$ is the corrected line breadth, and $\theta$ is the Bragg angle (half of $2\theta$).

E. Crystalline Orientation (CO)

The crystalline orientation (CO) is measured by using an X-ray generator (RU-200PL manufactured by Rigaku Denki), a fiber measuring device (FS-3 manufactured by Rigaku Denki), a goniometer (SG-9 manufactured by Rigaku Denki), a scintillation counter and a pulse height analyzer.

Cu-K$\alpha$($\lambda$=1.5418 Å) monochromatized by a nickel filter is used for the measurement. Generally, the fiber of this invention has two major reflections on the equatorial line, the reflection having $2\theta$ at a smaller angle is used in the measurement of CO. The $2\theta$ value used is determined from the curve of the diffraction intensity in the equatorial direction.

The X-ray generator is operated at 30 kV and 80 mA. The fiber sample is attached to the fiber measuring device so that filaments are parallel to one another.

Preferably the sample thickness is about 0.5 mm. The goniometer is set at the $2\theta$ value determined by the diffraction intensity curve in the equatorial direction. Scanning is conducted in the range of from −30° to +30° in the azimuthal direction according to a method of transmission, and the diffraction intensity in the azimuthal direction is recorded by the scintillation counter. Furthermore, the diffraction intensity at −180° and the diffraction intensity at +180° in the azimuthal direction are recorded. At this measurement, the scanning speed is 4°/min., the chart speed is 10 mm/minute, the time constant is one second, the collimeter is characterized by 2 mm$\phi$, and the receiving slit has a length of 1.9 mm and a width of 3.5 mm.

The CO value is determined from the obtained diffraction intensity curve in the azimuthal direction according to the following procedures. An average value of the diffraction intensity value obtained at ±180° is evaluated, and a horizontal line (a base line) is drawn to pass through the point of the average value. A perpendicular line is drawn to the base line from the peak, and the mid-point of the perpendicular line is determined and a horizontal line passing through the mid-point is drawn. The distance between two intersecting points of the horizontal line and the diffraction intensity curve is measured and the measured value is converted to an orientation angle H(°) in degrees (°). The crystalline orientation (CO) is given by the equation:

$$CO\,(\%) = \frac{180° - H}{180°} \times 100$$

F. Crystal Perfection Index (CPI)

The crystal perfection index (CPI) can be determined from the X-ray diffraction intensity curve obtained in the measurement of ACS by using the Dismore and Statton method in accordance with the following equation:

$$CPI(\%) = \left[ \frac{\text{interplanar spacing of reflection at face (100)}}{\text{interplanar spacing of reflection at faces \{(010) + (110)\}}} - 1 \right] \times \frac{100}{A}$$

In this equation, A is 0.189 and the crystal perfection is higher when the CPI value becomes closer to 100.

G. Integral Wide Ratio of Crystallinity (IWR)

The integral wide ratio of crystallinity (IWR) can be determined from the X-ray diffraction intensity curve obtained in the measurement of ACS in accordance with the following equation:

$$IWR = 1 - \frac{2H_1}{H_2 + H_3}$$

wherein $H_1$ is a minimal intensity between the reflection at the (010) face and that at the [(010)+(110)] faces, $H_2$ is a maximal intensity of the reflection at the (100) face and $H_3$ is a maximal intensity of the reflection at the [(010)+(110)] faces.

The crystal growth is higher when the IWR value becomes closer to one.

H. Tenacity, Elongation & Initial Modulus

The strength, elongation and initial modulus are measured at 20° C. and a relative humidity of 60% in accordance with the conventional method using a tensile testing machine, Tensilon UTM-II-20 manufactured by Toyo Baldwin.

I. Shrinkage in Boiling Water

The shrinkage in boiling water is given by the equation:

Shrinkage in boiling water $$(\%) = \frac{L_o - L}{L_o} \times 100$$

wherein $L_o$ is the length of a sample under a load of 0.1 g/l, and L is the length of the sample measured again under a load of 0.1 g/l after the treatment in boiling water without the load for 30 minutes. A negative value of the shrinkage in boiling water shows occurrence of elongation.

J. Relative Viscosity

The relative viscosity of nylon 66 is measured at 25° C. according to the conventional method using a 90% formic acid solution dissolving 8.4% by weight of nylon 66 therein.

K. Dyeability (Equilibrium Degree of Dye Absorption and Dye Diffusion Coefficient)

A sample is dyed at 100° C. with an acid dye (Lanyl Brill Blue, product of Sumitomo Chemical Company Ltd.) at a dye concentration of 5% owf, a bath ratio of 1 to 50 and a pH of 6 adjusted with ammonium acetate and acetic acid. The degrees of dye absorption after 5, 10, 20, 30, 40, 60, 90, 120 and 180 minutes of dyeing are measured by colorimetry of the remaining dyeing solution. The degree of dye absorption after 120 minutes or 180 minutes of dyeing is employed as the equilibrium degree of dye absorption. The diffusion coefficient of dye is obtained from the following Hill equation:

$$\frac{C_t}{C_\infty} = 1 - 0.692(e^{-5.785Dt/r^2} + 0.19e^{-30.5Dt/r^2})$$

wherein $C_t$ is a degree of dye absorption (%) after t minutes of dyeing, $C_{\infty}$ is an equilibrium degree of dye absorption (%), D is a diffusion coefficient of dye ($cm^2$/minute), r is a radius of a fiber at the cross section (cm) and t is a time of dyeing (minute).

As the sample employed, raw filaments are knitted into a circular knitted fabric by single feeding which is scoured with Scourrol FC of 2 g/l at 60° C. for 20 minutes, dried and conditioned at a relative humidity of 60% and 20° C.

L. Migration of Dye

A sample is dyed at 100° C. for 60 minutes with a dye [Suminol Milling Red-RS (C.I. Acid Red 114)] at a dye concentration of 2% owf and a bath ratio of 1 to 50 with 3% owf of ammonium acetate as the assistant to obtain a sample (A). Then an undyed sample (B) having the same weight and area as the sample (A) is treated together with the sample (A) under the same conditions as described above except that the dye is not employed. The surface dye concentration of the samples (A) and (B) thus treated is obtained from the reflectance and designated a K/S value. The migration [M(%)] is given by the equation:

$$M = [K/S(B)]/[K/S(A)]$$

wherein K/S(A) and K/S(B) are the K/S value of the sample (A) and the K/S value of the sample (B), respectively.

M. Uniformity of Dyeing of Filament

The uniformity of dyeing of filaments, i.e., uneven dyeing of a dyed sample prepared under the same conditions as in Dyeability with 180 minutes of dyeing is evaluated with naked eye by five grades, i.e., Grade 5 where no unevenness of dyeing is observed; Grade 3 while unevenness of dyeing is slightly observed; and Grade 1 where unevenness of dyeing is remarkably observed.

N. Uniformity of Dyeing of Textured Yarn (Occurrence of uneven dyeing)

The textured yarn obtained by false twisting a fiber is knitted into a circular kitted fabric. Then the knitted fabric is dyed with a dye (Diacid Alizarin Light Blue 4 GL) at a concentration if 0.5% owf, a bath ratio of 1 to 50 and a pH of 5.0 adjusted with ammonium acetate and acetic acid. The temperature of the bath is raised from 30° C. to 98° C. over 60 minutes, maintained at 98° C. for 10 minutes and subsequently lowered. The uneven dyeing of the knitted fabric thus dyed is evaluated with naked eye. The occurrence of uneven dyeing is represented by the equation.

$$\text{Occurrence of Uneven Dyeing (\%)} = \frac{\text{Number of Knitted Fabric Where Uneven Dyeing Occurred}}{\text{Total Number of Knitted Fabric}} \times 100$$

O. Temperature Dependence of Dyeability

In order to observe the change in dyeability due to the difference in the processing temperature of false twisting and the difference in the processing tension, a sample fiber is made run at a speed of 150 m/minute on a hot plate having a length of 50 cm and a varied temperature and wound. Then the fiber is knitted into a circular knitted fabric and dyed under the same conditions as in Uniformity of Dyeing of Textured Yarn. The dyeability of the knitted fabric is measured by reflectance using a colorimeter (Model New Y Type, manufactured by Eiko Sangyo Co., Ltd.). The dyeability is shown by the difference from the standard dyeability.

P. Crimpability (CR) (Crimp Recovery)

A sample fiber is reeled under a predetermined tension to obtain a small reel having a length of about 40 cm and a number of windings of 10. This reel is immersed in water for two minutes under a load of 0.1 g/d and the length $l_0$ of the fiber is measured. Then the load of 0.1 g/d was removed from the reel in water and a load of 2 mg/d is hung on the reel for two minutes and the length $l_1$ of the fiber is measured. Crimp recovery is given by the following equation:

$$CR(\%) = \frac{l_0 - l_1}{l_0} \times 100$$

Q. Crimp Fastness (CR') (Crimp Recovery after Boiling Water Treatment)

The crimp recovery is measured after the treatment of a sample in boiling water under a load of 10 mg/d for 20 minutes and is designated as CR'.

The present invention will now be described in detail by the following examples.

EXAMPLE 1

Nylon 66 having a relative viscosity of 40 was melt extruded from a nozzle having 6 fine holes 0.35 mm in diameter at a spinning temperature of 305° C. The filaments extruded were cooled and solidified with a stream of air at 30° C. supplied from the direction of the circumference of the fiber in the parallel direction of the running filament and then, after adding an oiling agent, the filaments were wound at a winding speed as set forth in Table 1. Finally, the fiber of 20d/6f was prepared.

The features of the microstructure of the fiber and the properties for practical use and for dyeing of the fiber are shown in Table 1.

As a reference, unstretched filaments were prepared at a spinning speed of 900 m/minute, and then stretched at a stretching ratio as set forth in Run Nos. 7 to 9 in Table 1 to give the fiber of 20d/6f and the same features of the fiber as described above are also shown in Run Nos. 7 to 9 of Table 1.

Furthermore, these fibers obtained in Run Nos. 1 to 9 were subjected to false twisting at a number of twists of 5,200/m and a processing temperature of 200° C. The occurrence of uneven dyeing of the false-twisted fibers is also shown in Table 1.

The fibers of Run Nos. 3 to 6 in Table 1 belong to this invention, especially the fibers of Run Nos. 5 and 6 are within a preferred range of this invention. The fibers of this invention have sufficient mechanical properties for practical purposes, good dyeability and uniformity of dyeing, especially the fibers of Run Nos. 5 and 6 have excellent mechanical properties, a thermally stable microstructure and excellent uniformity of dyeing. The fibers of Run Nos. 1 and 2 have a greater (tan δ) max and a smaller Tmax than the conventional stretched fibers of Run Nos. 7 to 9 and are outside the range of this invention, and thus the mechanical properties, thermal stability of structure of these fibers are inferior and the occurrence of uneven dyeing is high in spite of the high dyeability, i.e. the high degree of dye adsorption and dye diffusion coefficient.

As is shown in Table 1, the conventional stretched fibers of Run Nos. 7 to 9 have a greater Tmax than the fibers of this invention and are outside the range of this invention, and the mechanical properties of these fibers are sufficient but the shrinkage in boiling water is high and the uniformity of dyeing is remarkably inferior to that of the fibers according to this invention.

TABLE 1

| Run No. | Winding Speed (Stretching ratio) | (tan δ)max | Tmax (°C.) | a* | (tan δ)180 | ACS (Å) | CO (%) | CPI (%) | IWR | Δn (× $10^{-3}$) |
|---|---|---|---|---|---|---|---|---|---|---|
| 1 | 2000 (—) | 0.203 | 88 | 153.0 | 0.053 | 28.5 | 62 | 45 | 0.09 | 24 |
| 2 | 3000 (—) | 0.181 | 88 | 145.9 | 0.046 | 33.5 | 76 | 48 | 0.10 | 33 |
| 3 | 4000 (—) | 0.155 | 82 | 131.6 | 0.036 | 40.1 | 85 | 48 | 0.16 | 37 |
| 4 | 5000 (—) | 0.130 | 85 | 126.6 | 0.033 | 47.0 | 85 | 54 | 0.21 | 41 |
| 5 | 6000 (—) | 0.118 | 87 | 124.8 | 0.029 | 48.0 | 87 | 61 | 0.25 | 45 |
| 6 | 7000 (—) | 0.109 | 88 | 122.9 | 0.028 | 56.5 | 89 | 74 | 0.44 | 49 |
| 7 | 900 (3.0) | 0.101 | 123 | 155.3 | 0.034 | 38.2 | 88 | 48 | 0.09 | 54 |
| 8 | 900 (2.8) | 0.108 | 116 | 150.6 | 0.035 | 35.1 | 86 | 45 | 0.07 | 52 |
| 9 | 900 (2.6) | 0.118 | 114 | 151.8 | 0.037 | 32.4 | 83 | 42 | 0.05 | 49 |

| Run No. | Tenacity (g/d) | Elongation (%) | Initial Modulus (g/d) | Diffusion Coefficient of dye (× $10^{-7}$ $cm^2$/minute) | Equilibrium Degree of Dye Absorption (%) | Degree of Migration of Dye (%) | Occurrence of Uneven Dyeing (%) |
|---|---|---|---|---|---|---|---|
| 1 | 1.1 | 199 | 15.1 | 18.4 | 72.1 | 48.4 | 34 |
| 2 | 1.6 | 134 | 22.1 | 13.9 | 69.3 | 47.1 | 26 |
| 3 | 2.5 | 87 | 29.2 | 10.1 | 64.2 | 44.3 | 10 |
| 4 | 2.7 | 72 | 37.1 | 9.3 | 62.6 | 43.6 | 9 |
| 5 | 4.0 | 61 | 40.1 | 7.6 | 63.8 | 43.2 | 6 |
| 6 | 4.5 | 54 | 43.4 | 7.0 | 65.2 | 43.3 | 6 |
| 7 | 4.7 | 38 | 49.3 | 1.5 | 56.1 | 21.5 | 45 |
| 8 | 4.6 | 42 | 47.1 | 2.0 | 59.3 | 23.9 | 38 |
| 9 | 4.4 | 48 | 45.0 | 2.4 | 62.1 | 26.2 | 48 |

*Note: a = Tmax + 320 (tan δ)max

EXAMPLE 2

The temperature dependency of dyeability was examined with the fibers of Run Nos. 2, 4, 6 and 8 in Example 1. The temperatures of the hot plate employed were 185° C., 195° C. and 205° C. and the dyeability at 185° C. was employed as the standard. The results are shown in Table 2.

TABLE 2

| Temperature | Deability of Fibers | | | |
|---|---|---|---|---|
| (°C.) | Run No. 2 | Run No. 4 | Run No. 6 | Run No. 8 |
| 185 | 0 | 0 | 0 | 0 |
| 195 | 3.4 | 1.2 | 0.8 | 4.3 |
| 205 | 5.6 | 1.7 | 1.1 | 7.6 |

As is clear from Table 2 the difference in dyeability brought about by the treating temperature employed is very small with the fibers of Run Nos. 4 and 6.

EXAMPLE 3

Using the apparatus shown in FIG. 1, nylon 66 having a relative viscosity of 40 was melt extruded from a nozzle having 24 fine holes 0.23 mm in diameter at a temperature of 295° C., and the extruded filaments were passed through a heating cylinder, which was provided at the surface of the nozzle having fine holes, having an inside diameter of 100 mm and a length of 20 cm, then were subjected to suction and cooling by an aspirator provided at 80 cm from the end of the nozzle, and subsequently, after adding an oiling agent, the filaments were wound at a winding speed of 4,000 m/minute to 7,000 m/minute. Finally, the fiber of 70d/24f was prepared. The temperature of the atmosphere inside the heating cylinder was 200° C., and the air was supplied to the aspirator at an air pressure of 0.5 Kg/cm$^2$G and a temperature of 20° C. to 30° C. in an amount of 6 Nm$^3$/hour.

The features of the microstructure of the fiber and properties for practical use and for dyeing of the fiber are shown in Table 3.

As a reference, unstretched filaments were prepared at a spinning speed of 1,100 m/minute, and then the filaments were stretched at a stretching ratio of 2.8 to give the fiber of 70d/24f. The same features of the fiber as described above are also shown in Run No. 5 of Table 3.

Furthermore, these fibers obtained in Run Nos. 1 to 5 were subjected to false twisting at a number of twists of 3,200/m and a processing temperature of 220° C. The occurrence of uneven dyeing of the flase-twisted fibers is also shown in Table 3.

As is clear from Table 3, the fibers of this invention (Run Nos. 1 to 4) have adequate properties for practical use and, at the same time, excellent dyeability and uniformity of dyeing. Especially, these features are excellent with the fibers of Run Nos. 3 and 4 which are within a preferred range of this invention.

TABLE 3

| Run No. | Winding Speed (Stretching ratio) | (tan δ)max | Tmax (°C.) | a* | (tan δ)180 | ACS (Å) | CO (%) | CPI (%) | IWR | Δn (× 10$^{-3}$) |
|---|---|---|---|---|---|---|---|---|---|---|
| 1 | 4000 (—) | 0.151 | 83 | 131.3 | 0.037 | 41.2 | 85 | 47 | 0.16 | 38 |
| 2 | 5000 (—) | 0.126 | 86 | 126.3 | 0.032 | 46.8 | 86 | 56 | 0.19 | 42 |
| 3 | 6000 (—) | 0.116 | 86 | 123.1 | 0.027 | 50.3 | 88 | 61 | 0.28 | 47 |
| 4 | 7000 (—) | 0.105 | 88 | 121.6 | 0.026 | 57.4 | 89 | 78 | 0.45 | 51 |
| 5 | 1100 (2.8) | 0.106 | 117 | 150.9 | 0.034 | 36.4 | 89 | 47 | 0.08 | 45.1 |

| Run No. | Tenacity (g/d) | Elongation (%) | Initial Modulus (g/d) | Diffusion Coefficient of dye (× 10$^{-7}$ cm$^2$/minute) | Equilibrium Degree of Dye Absorption (%) | Degree of Migration of Dye (%) | Occurrence of Uneven Dyeing (%) |
|---|---|---|---|---|---|---|---|
| 1 | 2.7 | 85 | 28.4 | 9.8 | 65.3 | 42.5 | 11 |
| 2 | 2.8 | 73 | 38.3 | 9.2 | 62.2 | 42.3 | 8 |
| 3 | 4.0 | 59 | 42.9 | 7.4 | 62.4 | 42.0 | 6 |
| 4 | 4.7 | 51 | 44.6 | 6.9 | 63.9 | 41.8 | 5 |
| 5 | 5.0 | 45.1 | 48.1 | 1.9 | 57.2 | 22.7 | 40 |

*Note: a = Tmax + 320 (tan δ)max

EXAMPLE 4

Using the apparatus shown in FIG. 1, nylon 66 having a relative viscosity of 40 was melt extruded from a nozzle having 24 fine holes 0.25 mm in diameter at 295° C. The extruded filaments were passed through a heating cylinder, which was provided at the surface of the nozzle having the fine holes, having an inside diameter of 100 mm and a length of 20 cm, then were subjected to suction and cooled by an aspirator provided at 30 cm from the end of the heating cylinder, and then after oiling and entangling the filaments, the filaments were wound at a predetermined speed as set forth in Table 4. Finally, the fiber of 70d/24f was prepared in Run Nos. 1 to 3. The temperature of the atmosphere inside the heating cylinder was 200° C. and the air was supplied to the aspirator at a temperature of 20° C. to 30° C. and an air pressure of 1.0 Kg/cm$^2$G in an amount of 11 Nm$^3$/hour.

The same procedures as described above were repeated except that the temperature of the air supplied to the aspirator was −2° C. As a result, there was obtained the fiber of 70d/24f in Run No. 4.

Further, the same procedures as described in Run Nos. 1 to 3 were repeated except that instead of the aspirator, the cooling of the extruded filaments was conducted by use of cooling air having a temperature of −2° C. in a single direction crossing at a right angle to the filaments. As a result, there was obtained the fiber of 70d/24f in Run No. 5.

The $n_{\parallel(0)}$, $n_{\parallel(0.8)}$, $\Delta n_{\parallel(0.8-0)}$ and the symmetry of local refractive indices of the fibers in Run Nos. 1 to 5 are shown in Table 4, and the mechanical properties and the dyeability of the fibers in Run Nos. 1 to 5 are shown in Table 5. As a reference, the data for the conventional stretched fiber prepared at a spinning speed of 1,000 m/minute and a stretching ratio of 3.0 times in Run No. 6 are also shown in Tables 4 and 5.

As is clear from Tables 4 and 5, the fibers of this invention (Run Nos. 1 to 4) have adequate properties for practical use, and higher dyeability and uniformity of dyeing than the conventional fiber (Run No. 6). Especially, the fibers with preferred $n_{\parallel(0)}$ and symmetry of local refractive indices in Run Nos. 1 to 3 have excellent dyeability and uniformity of dyeing.

TABLE 4

| Run No. | Winding Speed (m/minute) | $n_{\parallel(0)}$ | $n_{\parallel(0.8)}$ | $\Delta n_{\parallel(0.8-0)}$ | Symmetry of Local Refractive Indices |
|---|---|---|---|---|---|
| 1 | 8000 | 1.5820 | 1.5852 | $3.2 \times 10^{-3}$ | yes |
| 2 | 9000 | 1.5831 | 1.5872 | $4.1 \times 10^{-3}$ | " |
| 3 | 10000 | 1.5836 | 1.5898 | $6.2 \times 10^{-3}$ | " |
| 4 | 8000 | 1.5685 | 1.5717 | $3.4 \times 10^{-3}$ | " |
| 5 | 8000 | 1.5819 | 1.5853 | $3.4 \times 10^{-3}$ | no |
| 6 | stretched fiber | 1.5750 | 1.5752 | $0.2 \times 10^{-3}$ | yes |

TABLE 5

| Run No. | Tenacity (g/d) | Elongation (%) | Initial Modulus (g/d) | Shrinkage in Boiling Water (%) | Equilibrium Degree of Dye Absorption (%) | Uniformity of Dyeing* (grade) |
|---|---|---|---|---|---|---|
| 1 | 4.8 | 54 | 45.2 | 3.1 | 66.3 | 4 |
| 2 | 4.4 | 46 | 43.4 | 3.6 | 68.5 | 4~5 |
| 3 | 4.3 | 40 | 39.5 | 3.7 | 69.2 | 5 |
| 4 | 3.9 | 41 | 33.5 | 5.3 | 63.1 | 3~4 |
| 5 | 4.3 | 61 | 40.8 | 3.7 | 67.2 | 3 |
| 6 | 4.9 | 38 | 49.1 | 10.5 | 56.7 | 2 |

*Uniformity of Dyeing of Filament

EXAMPLE 5

The fibers of Run Nos. 1 to 6 in Example 4 were subjected to false twisting at a number of twists of 3300/m and at a processing temperature of 220° C. The crimp recovery (CR), the crimp recovery after the boiling water treatment (CR') and the uniformity of dyeing of the false-twisted yarn are shown in Table 6. As shown in Table 6, the fibers of this invention are superior in the crimpability, crimp fastness and uniformity of dyeing to the conventional fiber (Run No. 6). Especially, the fibers with preferred $n_{\parallel(0)}$ and symmetry of local refractive indices in Run Nos. 1 to 3 are excellent in these properties.

TABLE 6

| Run No. | CR (%) | CR' (%) | Uniformity of Dyeing* (grade) |
|---|---|---|---|
| 1 | 44 | 27 | 4 |
| 2 | 48 | 32 | 4 |
| 3 | 46 | 31 | 4~5 |
| 4 | 43 | 25 | 3~4 |
| 5 | 43 | 26 | 2~3 |
| 6 | 38 | 18 | 1 |

*Note:
Evaluation of the uniformity of dyeing of the false-twisted yarn was conducted under the same conditions as in Uniformity of Dyeing of Filament.

EXAMPLE 6

Using the fibers of Run Nos. 1 to 6 in Example 4, satin was knitted at 28 GG and then subjected to loop raising, scoured under conventional conditions, pre-set at 160° C. for 30 minutes and subsequently dyed grey in a wince dyeing machine under the following conditions.

Dye: Lanasyn Orange RLN 0.012% owf Lanasyn Black BRL (200%) 0.08% owf Lanasyn Yellow GRL 0.032% owf (products of Sandoz Ltd.)
Assistant: Sodium dihydrogenphosphate 0.22 g/l Sodium hydrogenphosphate 0.6 g/l
Bath ratio: 1:50
Boiling time: 60 minutes
Rate of increasing temperature: 2° C./minute from 30° C. to boiling temperature Evaluation of the uniformity of dyeing, i.e., uneven dyeing of the knitted fabric was conducted under the same conditions as in Uniformity of Dyeing of Filament and the results are shown in Table 7. As is clear from Table 7, the fabric products obtained from the fibers of this invention are excellent in uniformity of dyeing.

TABLE 7

| Run No. | Uniformity of Dyeing (grade) |
|---|---|
| 1 | 4 |
| 2 | 4 |
| 3 | 4~5 |
| 4 | 1 |
| 5 | 2~3 |
| 6 | 3~4 |

EXAMPLE 7

Using the apparatus shown in FIG. 1, nylon 66 having a relative viscosity of 40 was melt extruded from a nozzle having 13 fine holes 0.23 mm in diameter at 295° C. The extruded filaments were passed through a heating cylinder, which was provided at the surface of the nozzle having the fine holes, having an inside diameter of 100 mm and a length of 20 cm, then were subjected to suction and cooled by an aspirator provided at 20 cm from the end of the heating cylinder, and then after oiling and entangling filaments, the filaments were wound at a predetermined speed as set forth in Table 8, to give the fiber of 40d/13f. The temperature of the atmosphere inside the heating cylinder was 200° C. and the air was supplied to the aspirator at a temperature of 20° C. to 30° C. and an air pressure of 1.0 $Kg/cm^2G$ in an amount of 11 $Nm^3$/hour. Then half tricot was knitted at 32GG using the filaments as obtained above, scoured under conventional conditions, preset at 160° C. for 30 minutes, and subsequently dyed in a wince dyeing machine under the following conditions:

Dye: Suminol Mill Brill Blue G 0.5% owf (product of Sumitomo Chemical Co., Ltd.)
Assistant: Ammonium acetate 3% owf
Bath ratio: 1:50
Boiling time: 60 minutes
Rate of increasing temperature: 2° C./minute from 30° C. to boiling temperature The $n_{\parallel(0)}$, $n_{\parallel(0.8)}$, $\Delta n_{\parallel(0.8-0)}$ and the symmetry of local refractive indices of the fibers and the uniformity of dyeing of the knitted fabric are also shown in Table 8.

As a reference, unstretched filaments were prepared at a spinning speed of 900 m/minute and then the filaments were stretched at a stretching ratio of 2.9 to give the fiber of 40d/13f. The same features of the fiber as described above are also shown in Table 8. As is clear from Table 8, the uniformity of dyeing of the knitted fabric of this invention is excellent.

TABLE 8

| Run No. | Winding Speed (m/minute) | $n_{\parallel(0)}$ | $n_{\parallel(0.8)}$ | $\Delta n_{\parallel(0.8-0)}$ | Symmetry of Local Refractive Indices | Uniformity of Dyeing* (grade) |
|---|---|---|---|---|---|---|
| 1 | 7000 | 1.5824 | 1.5858 | $3.4 \times 10^{-3}$ | yes | 4 |
| 2 | 8000 | 1.5830 | 1.5872 | $4.2 \times 10^{-3}$ | " | 4~5 |
| 3 | 9000 | 1.5835 | 1.5896 | $6.1 \times 10^{-3}$ | " | 5 |
| 4 | stretched fiber | 1.5745 | 1.5846 | $0.1 \times 10^{-3}$ | " | 1~2 |

*Uniformity of Dyeing of Filament

EXAMPLE 8

Using the apparatus shown in FIG. 1, nylon 66 having a relative viscosity of 40 was extruded from a nozzle having 24 fine holes 0.25 mm in diameter at a spining temperature of 290° C. The extruded filaments were passed through a heating cylinder, which was provided at the surface of the nozzle having fine holes, having an inside diameter of 15 cm and a length of 20 cm, and further were subjected to suction by an aspirator provided at a distance from the end of the heating cylinder as set forth in Table 9, and then wound at a winding speed of 7,000 m/minute. The temperature of the atmosphere in the heating cylinder was also varied as shown in Table 9 and the air was supplied to the aspirator at a temperature of 20° C. to 30° C. and an air pressure of 1.5 $Kg/cm^2G$ in an amount of 15 $Nm^3$/hour. The spinning stability and the tenacity and elongation of the fibers obtained are shown in Table 9.

TABLE 9

| Run No. | Temperature of Heating Zone (°C.) | Distance between Heating Cylinder and Aspirator (cm) | Spinning Stability* | Tenacity (g/d) | Elongation (%) |
|---|---|---|---|---|---|
| 1 | 50 | 40 | x | — | — |
| 2 | 90 | " | x | — | — |
| 3 | 150 | " | o | 4.8 | 47 |
| 4 | 200 | " | o | 4.2 | 58 |
| 5 | 230 | " | o | 4.3 | 56 |
| 6 | 260 | " | o | 4.6 | 51 |
| 7 | 280 | " | x | — | — |
| 8 | 200 | 5 | x | — | — |
| 9 | " | 30 | o | 4.4 | 53 |
| 10 | " | 60 | o | 4.9 | 45 |
| 11 | " | 80 | x | 4.0 | — |

*Note:
o; Spinning could be continued for five minutes.
x; Fiber breaking occurred within one minute.

It will be apparent to those skilled in the art that various modifications and variations could be made in the fibers and process of the invention without departing from the scope or spirit of the invention.

What is claimed is:

1. A process for producing a nylon 66 fiber with improved dyeability consisting essentially of extruding a melt of nylon 66 from a nozzle, passing the extruded filaments through a heating zone provided at the surface of the nozzle and having a length of about 5 cm to about 100 cm and a temperature of about 150° C. to about 260° C., applying a suction to the filaments with an aspirator located at a distance of about 5 cm to about 60 cm below the heating zone, and then winding at a winding speed of at least about 6,000 m/min.

2. A process according to claim 1, wherein the aspirator has a length of about 5 cm to about 50 cm.

* * * * *